US012241266B2

(12) United States Patent
Richards

(10) Patent No.: US 12,241,266 B2
(45) Date of Patent: Mar. 4, 2025

(54) CONCRETE TROWEL

(71) Applicant: MILWAUKEE ELECTRIC TOOL CORPORATION, Brookfield, WI (US)

(72) Inventor: Ian C. Richards, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 18/595,581

(22) Filed: Mar. 5, 2024

(65) Prior Publication Data

US 2024/0200343 A1 Jun. 20, 2024

Related U.S. Application Data

(63) Continuation of application No. 17/679,332, filed on Feb. 24, 2022, now Pat. No. 11,927,022.

(60) Provisional application No. 63/153,049, filed on Feb. 24, 2021.

(51) Int. Cl.
*E04F 21/24* (2006.01)

(52) U.S. Cl.
CPC ..... *E04F 21/248* (2013.01)

(58) Field of Classification Search
CPC ..... E04F 21/245; E04F 21/247; E04F 21/248
USPC ..... 404/112
See application file for complete search history.

(56) References Cited

U.S. PATENT DOCUMENTS

| | | | |
|---|---|---|---|
| 2,662,454 A | 12/1953 | Whiteman | |
| 3,402,647 A | 9/1968 | Colizza et al. | |
| 3,683,761 A | 8/1972 | Babic | |
| 4,614,463 A | 9/1986 | Hughes | |
| 4,799,282 A | 1/1989 | Fischer | |
| 5,567,503 A | 10/1996 | Sexton et al. | |
| 7,018,132 B2 | 3/2006 | Ewer et al. | |
| 11,927,022 B2 * | 3/2024 | Richards | E04F 21/248 |
| 2006/0204336 A1 | 9/2006 | Masterson et al. | |

(Continued)

FOREIGN PATENT DOCUMENTS

| | | |
|---|---|---|
| CN | 206693009 U | 12/2017 |
| EP | 0887489 A1 | 12/1998 |

(Continued)

OTHER PUBLICATIONS

BCRS Equipment, "Whiteman J36E2 Electric Power Trowel w/ Standard Handle," <https://www.bcrsequipment.com/whiteman-j36e2-electric-power-trowel-w-standard-handle.html> web page publicly available at least as early as Jan. 13, 2021.

(Continued)

*Primary Examiner* — Gary S Hartmann
(74) *Attorney, Agent, or Firm* — Michael Best & Friedrich LLP

(57) ABSTRACT

A concrete trowel includes a frame, a drive assembly including a motor mounted on the frame and a drive hub configured to receive torque from the motor, a rotor rotatable about a rotational axis and including a plurality of blades, wherein the rotor includes an attachment portion that is received within a receiving portion of the drive hub, and a quick-change coupling for selectively attaching the rotor and the drive hub for co-rotation therewith. The quick-change coupling includes a spring that imparts a spring force on the attachment portion of the rotor and wherein the spring remains on the drive hub when the attachment portion of the rotor is removed from the quick-change coupling.

18 Claims, 4 Drawing Sheets

(56) References Cited

U.S. PATENT DOCUMENTS

| | | | |
|---|---|---|---|
| 2008/0216259 | A1 | 9/2008 | Walz et al. |
| 2010/0150653 | A1 | 6/2010 | Jaszkowiak |
| 2012/0071066 | A1 | 3/2012 | Banchio |
| 2019/0006980 | A1 | 1/2019 | Sheeks et al. |
| 2020/0263443 | A1 | 8/2020 | Del Real et al. |
| 2022/0267968 | A1 | 8/2022 | Richards |
| 2022/0268035 | A1 | 8/2022 | Richards |
| 2022/0268036 | A1 | 8/2022 | Richards et al. |

FOREIGN PATENT DOCUMENTS

| | | | |
|---|---|---|---|
| JP | H0893212 | A | 4/1996 |
| JP | 3039124 | U | 7/1997 |
| KR | 100517666 | B1 | 9/2005 |
| KR | 1020140117222 | A | 10/2014 |
| WO | 2013043117 | A1 | 3/2013 |

OTHER PUBLICATIONS

Bosch, "Cut Downtime with Just One Click," <https://xlock.boschtools.com/> web page publicly available at least as early as Jan. 13, 2021.

International Search Report and Written Opinion for Application No. PCT/US2022/017617 dated Jun. 10, 2022 (10 pages).

* cited by examiner

CONCRETE TROWEL

CROSS-REFERENCE TO RELATED APPLICATIONS

This application is a continuation of U.S. patent application Ser. No. 17/679,332, filed Feb. 24, 2022, now U.S. Pat. No. 11,927,022, which claims priority to U.S. Provisional Patent Application No. 63/153,049 filed on Feb. 24, 2021, the entire contents of all of which are incorporated herein by reference.

FIELD OF THE INVENTION

The present invention relates to powered concrete trowels, and more particularly to battery powered concrete finishing trowels.

BACKGROUND OF THE INVENTION

Powered concrete trowels are typically used for finishing concrete surfaces and generally include a gas-powered motor mounted on a frame or "cage" that surrounds a rotor having a plurality of concrete trowel blades. The rotor is rotatably driven by the motor, which rotates the blades on a concrete surface. The trowel is controlled by an operator via a handle extending from the cage. After a particular number of hours of use, the operator needs to perform general maintenance on the trowel in order to ensure proper performance. Usually, this maintenance involves removing mechanical fasteners to allow the operator to clean the trowel blades and other components of the trowel underneath the cage and rotor. These fasteners are difficult to reach, and many operators will either reach through the cage or tilt the trowel up to access the fasteners securing the rotor to the motor shaft.

SUMMARY OF THE INVENTION

The present invention provides, in one aspect, a concrete trowel having a frame, a drive assembly including a motor mounted on the frame and a drive hub configured to receive torque from the motor, a rotor rotatable about a rotational axis and including a plurality of blades, wherein the rotor includes an attachment portion that is received within a receiving portion of the drive hub, and a quick-change coupling for selectively attaching the rotor and the drive hub for co-rotation therewith. The quick-change coupling includes a spring that imparts a spring force on the attachment portion of the rotor and wherein the spring remains on the drive hub when the attachment portion of the rotor is removed from the quick-change coupling.

The quick-change coupling includes a cam ring coupled to the drive hub and the cam ring includes a bore and an annular shoulder defined on an interior of the cam ring adjacent the bore.

The quick-change coupling further includes a plurality of locking elements receivable within the annular shoulder.

The attachment portion of the rotor includes a circumferential groove configured to engage the locking elements.

The cam ring further includes an annular groove adjacent the annular shoulder.

A diameter of the annular groove is larger than a diameter of the annular shoulder.

The quick-change coupling further includes a detent ring coupled for co-rotation with the drive hub, and the detent ring is disposed within the bore of the cam ring and includes a plurality of radial openings configured to receive the locking elements.

The quick-change coupling is configured to allow the cam ring to move linearly along an axis of rotation of the rotor, and as the cam ring moves toward an open end of the bore, the annular shoulder moves into a position in which the annular shoulder is misaligned from the locking elements and the attachment portion of the rotor is removable from the quick-change coupling.

The quick-change coupling includes a pull-through clamp.

The pull-through clamp fits through an attachment portion of a rotor and imparts a clamping force on the attachment portion to clamp the rotor to the drive hub.

The pull-through clamp imparts a clamping force between the attachment portion and the drive hub along a rotational axis of the rotor.

The pull-through clamp is spring loaded to pull the attachment portion onto the drive hub.

In another aspect of the present invention, a concrete trowel includes a frame including a blade guard extending therefrom, a drive assembly including a motor mounted on the frame and a drive hub configured to receive torque from the motor, a rotor rotatable about a rotational axis within the blade guard and including a plurality of blades and an attachment portion for selectively engaging the drive hub, and a quick-change coupling for selectively attaching the rotor and the drive hub for co-rotation therewith, wherein the quick-change coupling removably engages the attachment portion of the rotor. The quick-change coupling includes a cam ring coupled to the drive hub, the cam ring including a bore, an annular shoulder defined on an interior of the cam ring adjacent the bore, and an annular groove adjacent the annular shoulder, and a spring adjacent the cam ring that imparts a spring force on the attachment portion of the rotor. The spring remains on the drive hub when the attachment portion of the rotor is removed from the quick-change coupling.

A diameter of the annular groove is larger than a diameter of the annular shoulder.

The quick-change coupling further includes a plurality of locking elements receivable within the annular shoulder.

The attachment portion of the rotor includes a circumferential groove configured to engage the locking elements.

The quick-change coupling further includes a detent ring coupled for co-rotation with the drive hub, wherein the detent ring is disposed within the bore of the cam ring and includes a plurality of radial openings configured to receive the locking elements.

The quick-change coupling is configured to allow the cam ring to move linearly along an axis of rotation of the rotor, and as the cam ring moves toward an open end of the bore, the annular shoulder moves into a position in which the annular shoulder is misaligned from the locking elements and the attachment portion of the rotor is removable from the quick-change coupling.

In yet another aspect of the present invention, a concrete trowel includes a frame including a blade guard extending therefrom, a drive assembly including a motor mounted on the frame and a drive hub configured to receive torque from the motor, a rotor rotatable about a rotational axis within the blade guard and including a plurality of blades and an attachment portion for selectively engaging the drive hub, and a quick-change coupling for selectively attaching the rotor and the drive hub for co-rotation therewith. The quick-change coupling includes a pull-through clamp configured to fit through an attachment portion of a rotor and imparts a clamping force on the attachment portion along a rotational axis of the rotor to clamp the rotor to the drive hub along the rotational axis. The pull-through clamp includes a spring that remains on the drive hub when the attachment portion of the rotor is removed from the quick-change coupling.

The pull-through clamp imparts a clamping force between the attachment portion and the drive hub along a rotational axis of the rotor.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
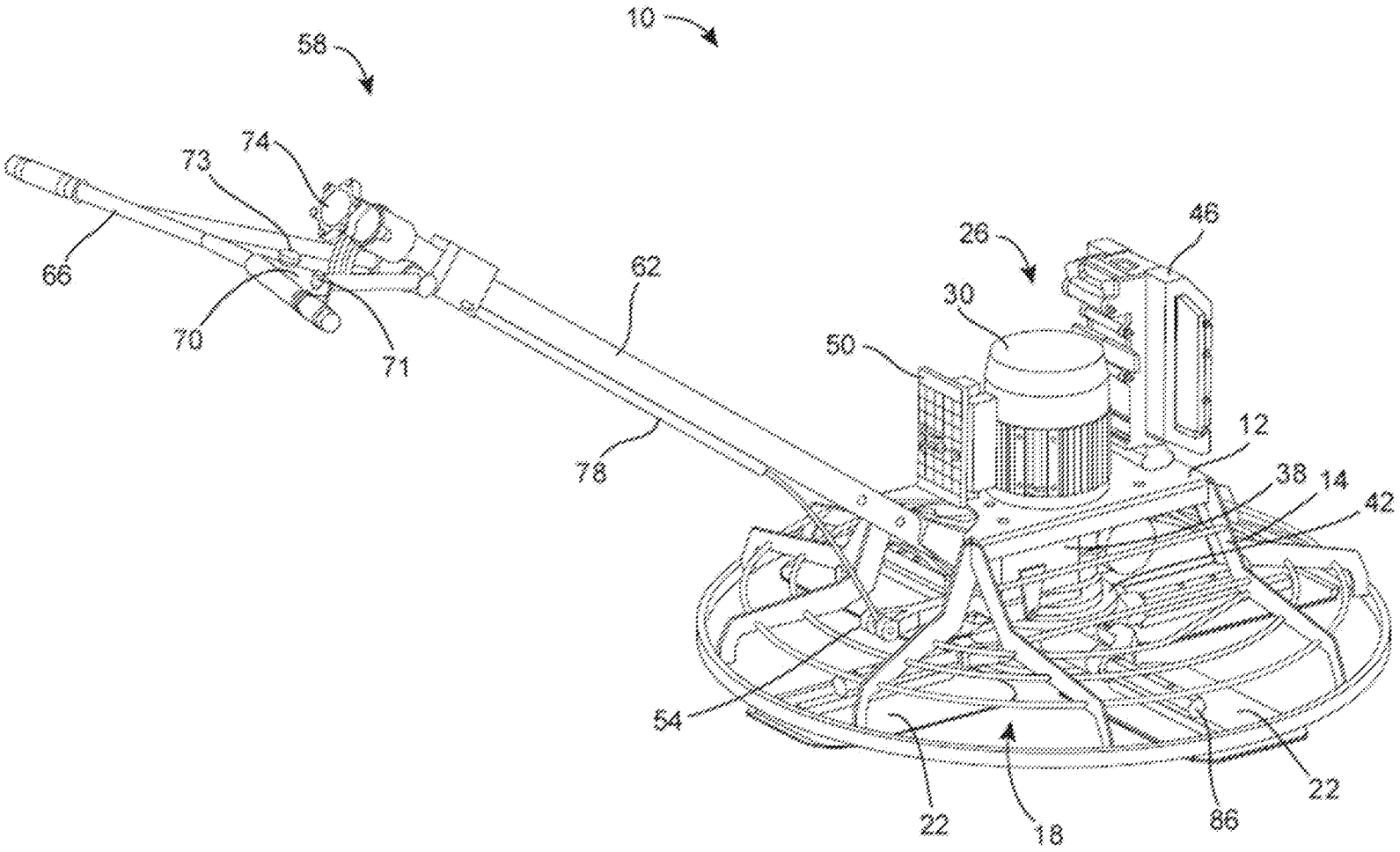
FIG. 1 is perspective view of a concrete trowel according to an embodiment of the invention.

FIG. 1 illustrates a concrete trowel 10 including a frame 12 having a blade guard 14 surrounding a rotor 18 having a plurality of blades 22, a drive assembly 26 mounted on the frame 12 having a motor 30 (e.g., a brushless direct current electric motor) with an output shaft 32 extending from the motor 30 (FIG. 2), and a gear box 38 coupled to the motor 30 having a drive hub 42. The drive assembly 26 is powered by a battery pack 46 supported by the frame 12 and in selective electrical communication with the motor 30 to provide electrical power to the motor 30. In some embodiments of the trowel 10, the battery pack 46 and the motor 30 can be configured as an 80 Volt high power battery pack 46 and motor 30, such as the 80 Volt battery pack and motor disclosed in U.S. patent application Ser. No. 16/025,491 filed on Jul. 2, 2018 (now U.S. Patent Application Publication No. 2019/0006980), the entirety of which is incorporated herein by reference. It is to be understood that the motor 30 may be a combustion engine and in such a case, in lieu of a battery pack 46, the concrete trowel 10 may include a fuel cell and a fuel injection system, or carburetion system, in fluid communication with the motor 30.

Figure 2:
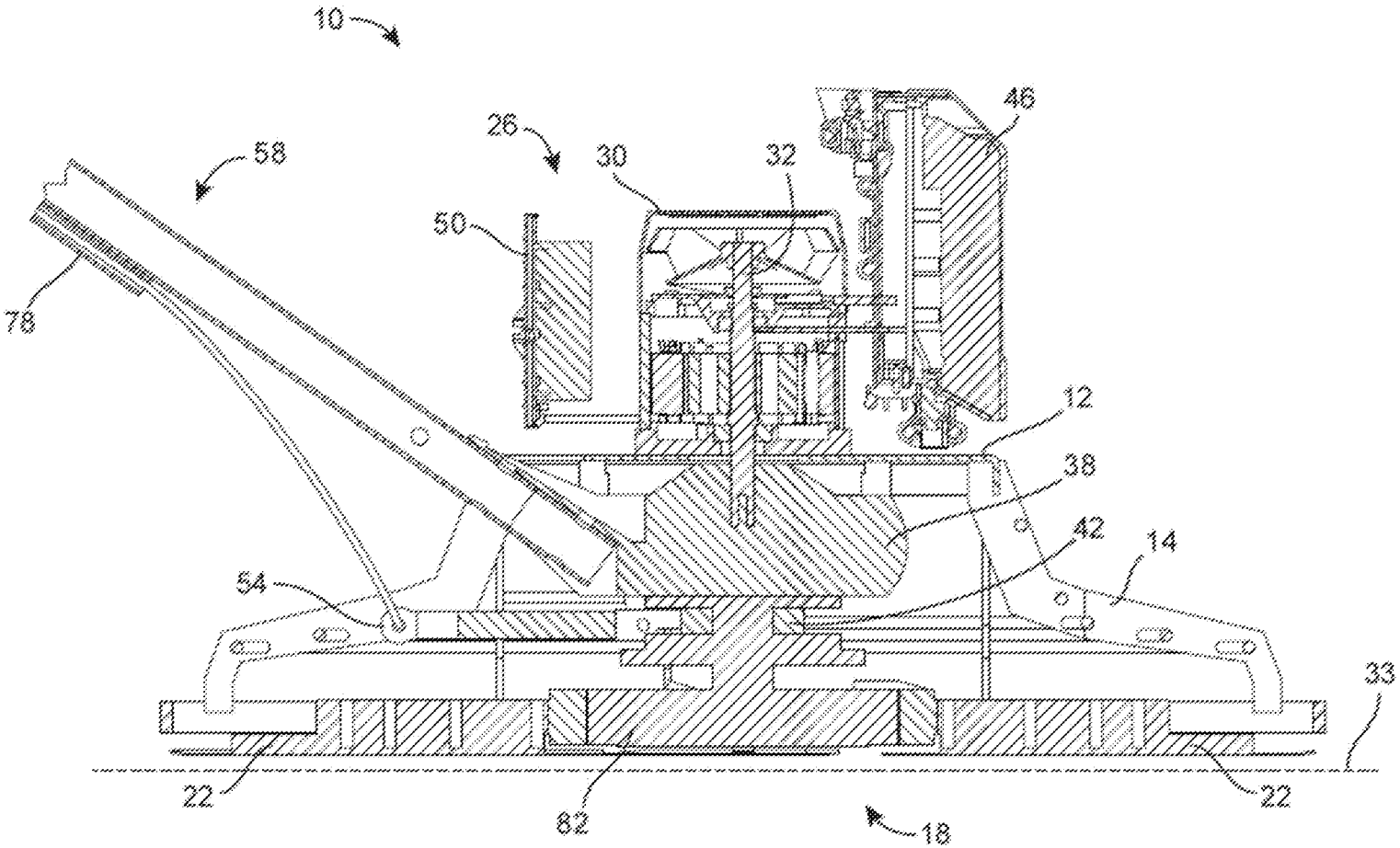
FIG. 2 is a side, partial cutaway view of the concrete trowel of FIG. 1.

With reference to FIGS. 1 and 2, the motor 30 is configured to supply torque to the drive hub 42 of the gear box 38 via the output shaft 32, rotatably driving the rotor 18 to rotate the plurality of blades 22. The concrete trowel 10 further includes a controller 50 (including, amongst other components, a printed circuit board having one or more microprocessors and multiple field-effect transducers for driving the motor 30), a blade adjustment yoke 54 pivotably coupled to the drive hub 42, and a handle assembly 58 including a post 62 extending obliquely from the blade guard 14 and handlebars 66 coupled to the post 62. The handle assembly 58 further includes an operator control unit 70 mounted on one of the handlebars 66 having a plurality of operator controls (e.g., an ON/OFF switch 71, a speed adjustment switch 73, etc.) for providing an input signal to the controller 50, and a blade pitch adjustment knob 74 having an adjustment cable 78 coupled to the blade adjustment yoke 54. The blade pitch adjustment knob 74 is configured to selectively tension the adjustment cable 78, thereby pivoting the adjustment yoke 54 with respect to the drive hub 42, which adjusts the pitch of the blades 22 relative to a work surface 33.

In some embodiments of the trowel 10, the drive assembly 26 can be a direct drive system where the output shaft 32 is directly connected to the drive hub 42 to rotatably drive the rotor 18.

Figure 3A:
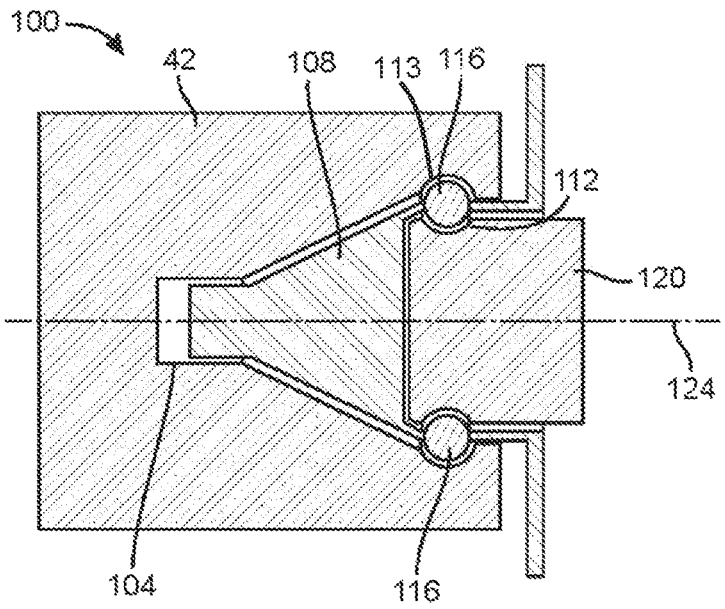
FIGS. 3*a* and 3*b* are schematic views of a quick-change coupling in a locked position and an unlocked position, respectively, in accordance with an embodiment of the invention for use with the trowel of FIG. 1.
Figure 3B:
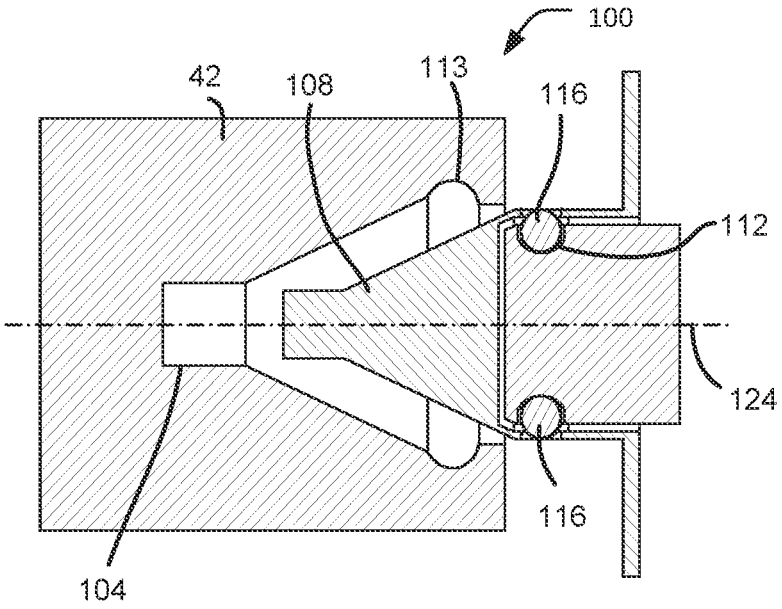

With reference to FIGS. 2, 3*a*, and 3*b*, the rotor 18 is coupled to the drive hub 42 as a singular unit, or assembly, via a quick-change coupling 100. The drive hub 42 includes a receiving portion 104 configured to receive an attachment portion 108 of the rotor 18. The attachment portion 108 is configured to couple the rotor 18 or another attachment compatible for use with the trowel 10 to the drive hub 42. The quick-change coupling 100 further includes a cam 120 having a circumferential cam groove 112 adjacent a detent groove 113 formed in the receiving portion 104 of the drive hub 42. A plurality of locking elements 116 (e.g., pins, spherical detents, etc.) are receivable in the adjacent grooves 112, 113. The cam 120 is configured for selectively driving the locking elements 116 into the detent groove 113 of the receiving portion 104 of the drive hub 42. In some embodiments, the cam 120 moves in a rotating or pivoting manner to displace the locking elements 116 radially outward and into the detent groove 113 of the drive hub 42 to a locked position, as shown in FIG. 3*a*. In other embodiments, the cam 120 moves in a translating or sliding manner to displace the locking elements 116 radially outward and into the detent groove 113.

In operation, the user actuates the cam 120, e.g., by rotating the cam 120, to selectively move the locking elements 116 into, or out of, the detent groove 113 to lock, or unlock, the quick-change coupling 100 with respect to the receiving portion 104 of the drive hub 42. In particular, the rotor 18 rotates about a central rotational axis 124 and the cam 120 is rotated about the central rotational axis 124 to lock, or unlock, the quick-change coupling 100. When the quick-change coupling 100 is adjusted toward the unlock position, as shown in FIG. 3*b*, where the locking elements 116 are removed from the detent groove 113, the user can remove the rotor 18 (with the attached blades 22) as a unit from the trowel 10 to allow the user to service the rotor 18 or other internal components related to the drive assembly 26 of the trowel 10.

Figure 4:
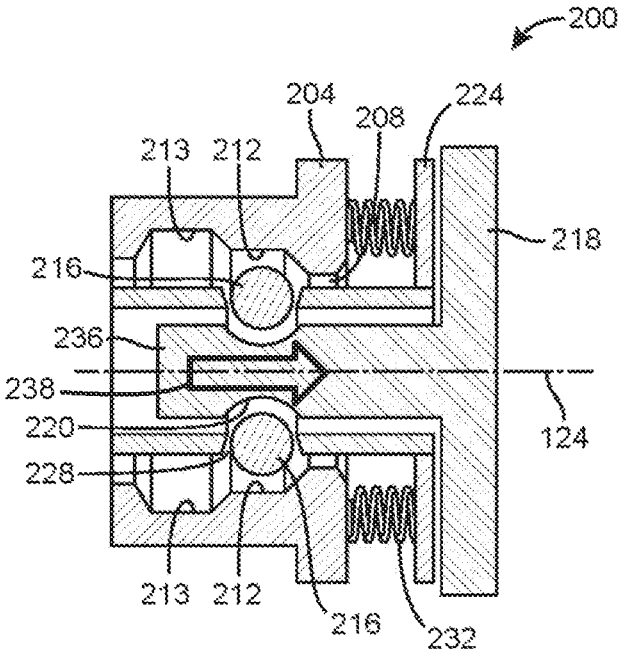
FIG. 4 is a schematic view of a quick-change coupling in accordance with another embodiment of the invention for use with the trowel of FIG. 1.

FIG. 4 illustrates a quick-change coupling 200 that can be used in some embodiments of the trowel 10. The quick-change coupling 200 includes a cam ring 204 coupled to the drive hub 42 having a bore 208 and an annular shoulder 212 defined on the interior of the cam ring 204, a plurality of locking elements 216 receivable within the annular shoulder 212, and an attachment portion 218 having a circumferential groove 220 configured to couple the rotor 18 or another attachment compatible for use with the trowel 10 to the drive hub 42. The cam ring 204 further includes an annular groove 213 adjacent the annular shoulder 212 having a larger inner diameter than the shoulder 212. The quick-change coupling 200 further includes a detent ring 224, also coupled for co-rotation with the drive hub 42, disposed within the bore 208 of the cam ring 204 and abutting the attachment portion 218 having a plurality of radial openings 228 configured to receive the locking elements 216, and a spring 232 positioned between the detent ring 224 and the cam ring 204 for imparting a spring force onto the attachment portion 218. In operation, to secure the attachment portion 218 within the cam ring 204, the attachment portion 218 is continually inserted into the bore 208 against the bias of the spring 232 toward the locking elements 216. Continued insertion of the attachment portion 218 causes a rear 236 of the attachment portion 218 to engage the locking elements 216, thereby pushing the locking elements 216 rearward until the locking elements 216 clear the annular shoulder 212 and are moved radially outward into the annular groove 213. As the locking elements 216 encounter the circumferential groove 220 of the attachment portion 218, the spring 232 partially rebounds and pushes the locking elements 216 into the annular shoulder 212 to secure the attachment portion 218 in the bore.

To release the attachment portion 218, the user grasps the cam ring 204 and moves the cam ring 204 forward toward the open end of the bore 208, as indicated by arrow 238. In a particular aspect, the cam ring 204 moves linearly along the rotational axis 124 of the rotor 18. As the cam ring 204 moves forward toward the open end of the bore 208, the annular shoulder 212 is moved forward with the cam ring 204, misaligning the annular shoulder 212 from the locking elements 216 and allowing the user to pull the attachment portion 218 from the bore 208. This action displaces the locking elements 216 radially outward and into the annular groove 213 within cam ring 204, thereby permitting the attachment portion 218 to slide under the locking elements 216 and be removed. Likewise, same as the quick-change coupling 100 described above, when the attachment portion 218 is removed, the user can remove the rotor 18 (with the attached blades 22) as a unit from the trowel 10 to allow the user to service the rotor 18 or other internal components related to the drive assembly 26 of the trowel 10.

Figure 5:
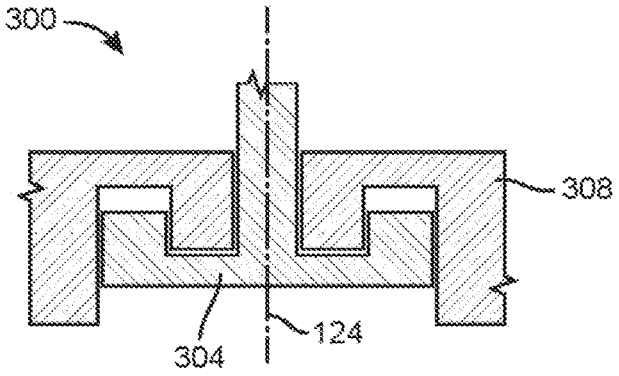
FIG. 5 is a schematic view of a quick-change coupling in accordance with yet another embodiment of the invention for use with the trowel of FIG. 1.

FIG. 5 illustrates another quick-change coupling 300 that can be used in some embodiments of the trowel 10. The quick-change coupling 300 can be configured as a pull-through clamp 304 that imparts a clamping force between an attachment portion 308 and the drive hub 42, the attachment portion 308 being configured to couple the rotor 18 or another attachment compatible for use with the trowel 10 to the drive hub 42. In some embodiments of the quick-change coupling 300, the pull-through clamp 304 can impart a clamping force, along the rotational axis 124, between the attachment portion 308 and the drive hub 42 via an over-center cam that is accessible through the top or bottom of the trowel 10. In other embodiments, the pull-through clamp 304 can impart a clamping force between the attachment portion 308 and the drive hub 42 via a pull plate where the clamp 304 is spring loaded and configured to impart a spring force onto the pull plate to pull the clamp 304 onto the drive hub 42. Likewise, same as the quick-change couplings 100, 200 described above, when the pull-through clamp 304 is loosened and the attachment portion 308 is removed, the user can remove the rotor 18 (with the attached blades 22) as a unit from the trowel 10 to allow the user to service the rotor 18 or other internal components related to the drive assembly 26 of the trowel 10.

In other embodiments of the quick-change couplings 100, 200, 300, the quick-change couplings 100, 200, 300 can be located in a different location along the drive assembly 26 of the trowel 10 other than between the drive hub 42 and the rotor 18. Each of the quick-change couplings 100, 200, 300 are movable between a locked position in which the rotor 18 is locked to the drive hub 40 and an unlocked position in which the rotor 18 is unlocked from the drive hub 42. Quick-change coupling 100 is rotatable between these positions, while quick change couplings 200, 300 move linearly between their respective locked positions and unlocked positions.

By having a trowel 10 with any of the quick-change couplings 100, 200, 300 that allow the user to quickly remove the rotor 18 with the attached blades 22 as a unit, the user doesn't have to reach into the blade guard 14 or flip the entire trowel 10 over in order to service different parts of the trowel. This prevents accidental chemical spills or injuries related to user handling of the trowel during service repairs or maintenance. Furthermore, a quick-change blade/rotor removal method reduces the need for a user to track down, or purchase outside tools that would otherwise be necessary to remove and service the trowel blades or other internal components in traditional concrete trowel systems.

Although the invention has been described in detail with reference to certain preferred embodiments, variations and modifications exist within the scope and spirit of one or more independent aspects of the invention as described.

Various features of the invention are set forth in the following claims.

What is claimed is:

1. A concrete trowel comprising:

a frame;

a drive assembly including a motor mounted on the frame and a drive hub configured to receive torque from the motor;

a rotor rotatable about a rotational axis and including a plurality of blades, wherein the rotor includes an attachment portion that is received within a receiving portion of the drive hub; and a quick-change coupling for selectively attaching the rotor and the drive hub for co-rotation therewith, wherein the quick-change coupling includes a spring that imparts a spring force on the attachment portion of the rotor and wherein the spring remains on the drive hub when the attachment portion of the rotor is removed from the quick-change coupling.

2. The concrete trowel of claim 1, wherein the quick-change coupling comprises a cam ring coupled to the drive hub, wherein the cam ring includes a bore and an annular shoulder defined on an interior of the cam ring adjacent the bore.

3. The concrete trowel of claim 2, wherein the quick-change coupling further comprises a plurality of locking elements receivable within the annular shoulder.

4. The concrete trowel of claim 3, wherein the attachment portion of the rotor includes a circumferential groove configured to engage the locking elements.

5. The concrete trowel of claim 4, wherein the cam ring further includes an annular groove adjacent the annular shoulder.

6. The concrete trowel of claim 5, wherein a diameter of the annular groove is larger than a diameter of the annular shoulder.

7. The concrete trowel of claim 5, wherein the quick-change coupling further includes a detent ring coupled for co-rotation with the drive hub, and wherein the detent ring is disposed within the bore of the cam ring and includes a plurality of radial openings configured to receive the locking elements.

8. The concrete trowel of claim 4, wherein the quick-change coupling is configured to allow the cam ring to move linearly along an axis of rotation of the rotor, and wherein as the cam ring moves toward an open end of the bore, the annular shoulder moves into a position in which the annular shoulder is misaligned from the locking elements and the attachment portion of the rotor is removable from the quick-change coupling.

9. The concrete trowel of claim 1, wherein the quick-change coupling comprises a pull-through clamp.

10. The concrete trowel of claim 9, wherein the pull-through clamp fits through an attachment portion of a rotor and imparts a clamping force on the attachment portion to clamp the rotor to the drive hub.

11. The concrete trowel of claim 10, wherein the pull-through clamp imparts a clamping force between the attachment portion and the drive hub along a rotational axis of the rotor.

12. The concrete trowel of claim 10, wherein the pull-through clamp is spring loaded to pull the attachment portion onto the drive hub.

13. A concrete trowel comprising:

a frame including a blade guard extending therefrom;

a drive assembly including a motor mounted on the frame and a drive hub configured to receive torque from the motor;

a rotor rotatable about a rotational axis within the blade guard and including a plurality of blades and an attachment portion for selectively engaging the drive hub; and a quick-change coupling for selectively attaching the rotor and the drive hub for co-rotation therewith, wherein the quick-change coupling removably engages the attachment portion of the rotor, wherein the quick-change coupling comprises:

a cam ring coupled to the drive hub, the cam ring including a bore, an annular shoulder defined on an interior of the cam ring adjacent the bore, and an annular groove adjacent the annular shoulder; and a spring adjacent the cam ring that imparts a spring force on the attachment portion of the rotor, wherein the spring remains on the drive hub when the attachment portion of the rotor is removed from the quick-change coupling.

14. The concrete trowel of claim 13, wherein a diameter of the annular groove is larger than a diameter of the annular shoulder.

15. The concrete trowel of claim 14, wherein the quick-change coupling further comprises a plurality of locking elements receivable within the annular shoulder.

16. The concrete trowel of claim 15, wherein the attachment portion of the rotor includes a circumferential groove configured to engage the locking elements.

17. The concrete trowel of claim 15, wherein the quick-change coupling further includes a detent ring coupled for co-rotation with the drive hub, wherein the detent ring is disposed within the bore of the cam ring and includes a plurality of radial openings configured to receive the locking elements.

18. The concrete trowel of claim 15, wherein the quick-change coupling is configured to allow the cam ring to move linearly along an axis of rotation of the rotor, and wherein as the cam ring moves toward an open end of the bore, the annular shoulder moves into a position in which the annular shoulder is misaligned from the locking elements and the attachment portion of the rotor is removable from the quick-change coupling.

* * * * *